US005273710A

United States Patent [19]

Zengin

[11] Patent Number: 5,273,710

[45] Date of Patent: Dec. 28, 1993

[54] PROCESS OF MANUFACTURING A MEMBER HAVING A SHAFT-RECEIVING OPENING

[75] Inventor: Osman Z. Zengin, Gmunden, Austria

[73] Assignee: Miba Sintermetall Aktiengesellschaft, Laakirchen, Austria

[21] Appl. No.: 832,375

[22] Filed: Feb. 7, 1992

[30] Foreign Application Priority Data

Feb. 13, 1991 [AT] Austria ..... 305/91

[51] Int. Cl.[5] ..... B22F 5/00; B22F 3/12

[52] U.S. Cl. ..... 419/47; 419/38

[58] Field of Search ..... 419/38, 47

[56] References Cited

U.S. PATENT DOCUMENTS

| | | | |
|---|---|---|---|
| 3,743,556 | 7/1973 | Breton et al. | 156/62.8 |
| 4,137,106 | 1/1979 | Doi et al. | 148/126 |
| 4,236,923 | 12/1980 | Takahashi et al. | 75/208 R |
| 4,280,841 | 7/1981 | Ito et al. | 75/203 |
| 4,524,046 | 6/1985 | Suganuma et al. | 419/8 |
| 4,556,532 | 12/1985 | Umeha et al. | 419/5 |
| 4,632,074 | 12/1986 | Takahashi et al. | 123/90.39 |
| 4,851,188 | 7/1989 | Schaefer et al. | 419/19 |
| 4,851,189 | 7/1989 | Dönch et al. | 419/28 |

FOREIGN PATENT DOCUMENTS

| | | |
|---|---|---|
| 3209980 | 10/1982 | Fed. Rep. of Germany . |
| 3500653 | 7/1985 | Fed. Rep. of Germany . |
| 3907886 | 9/1989 | Fed. Rep. of Germany . |

*Primary Examiner*—Donald P. Walsh
*Assistant Examiner*—Daniel Jenkins
*Attorney, Agent, or Firm*—Collard & Roe

[57] ABSTRACT

A process of manufacturing a member formed with a shaft-receiving opening in that a compact formed with a through hole and comprising a sinterable powder is subjected to liquid-phase sintering is improved in that a bushing, which is made of a material produced by fusion metallurgy and is dimensionally stable under the conditions under which the compact is to be sintered, is inserted into the through opening of the compact with a play which is smaller than the extent of the unrestrained radial shrinkage of the compact at its through opening during its liquid-phase sintering, and the compact is subjected to liquid-phase sintering after the bushing has thus been inserted.

9 Claims, 1 Drawing Sheet

PROCESS OF MANUFACTURING A MEMBER HAVING A SHAFT-RECEIVING OPENING

BACKGROUND OF THE INVENTION

1. Field of the Invention

This invention relates to a process of manufacturing a member formed with a shaft-receiving opening by subjecting a compact formed with a through hole and comprising a sinterable powder to liquid-phase sintering.

2. Description of the Prior Art

To utilize the relatively light weight and the high wear resistance of compacts of sintered metal, e.g., in the manufacture of camshafts for controlling the valves of internal combustion engines, Published German Application 3,500,653 proposes the cams or other members to be mounted on the shaft, which members are formed with a shaft-receiving opening, be made by compacting a sinterable powder and, after presintering, they are then shrunk onto the steel shaft to provide a press fit. The succeeding final sintering will then result in a metallurgical bond between the shaft and the shaped member. But that manufacturing process involves the disadvantage that in spite of the press fit it is hardly possible exactly to determine the relative angular position of the compacts during the sintering process by which they are joined to the shaft.

It has already been proposed in Published German Application 3,209,980 to avoid said disadvantages by fitting the presintered compacts on the shaft with a radial play and the compacts are positioned by inserting tubular retaining members with a press fit into aligned bores, which are formed in the shaft and in the compacts. But in that case it is difficult to form the bores in the compacts after they have been presintered. Besides, it is virtually impossible to maintain the dimensions of the compacts during their unrestrained shrinking within the permissible limits.

Finally, it is known from Published German Application 3,907,886 to provide a camshaft with composite cams, which comprise an outer member and an inner member, and to restrict the shrinkage of the inner member particularly in the axial direction in that the inner member has a smaller shrinkage under the sintering conditions than the outer member so that, in addition, a firm metallurgical bond between the two parts will be ensured. Because the joint ton the steel shaft is again established during the liquid-phase sintering, the positioning difficulties described hereinbefore will necessarily arise too.

SUMMARY OF THE INVENTION

For this reason is an object of the invention so to improve a process which is of the kind described first hereinbefore that dimensionally stable members having specified dimensions and having an accurately dimensioned shaft-receiving opening can be made in a simple manner without a need for an expensive finish-machining.

That object is accomplished in accordance with the invention by inserting a bushing, which is made of a material produced by fusion metallurgy and is dimensionally stable under the conditions under which the compact is to be sintered, into the through opening of the compact with a play which is smaller than the extent of the unrestrained radial shrinkage of the compact at its through opening during its liquid-phase sintering, and subjecting the compact to liquid-phase sintering after the bushing has thus been inserted.

The bushing, which is dimensionally stable under the conditions under which the compact is sintered, restrains the shrinkage of the compact after the play has been eliminated. As a result, the compact will have a high dimensional stability if a sufficiently large play is provided in relation to the extent of the unrestrained radial shrinkage of the compact at its through opening under the sintering conditions. This ensures that an irregular residual shrinkage occurring after the elimination of the play will not result in a subsiding of the outside peripheral surface of the compact. Because the relative angular position of the compact and of the bushing is usually insignificant for the achievement of the specified angular position of the member on the shaft, the play between the bushing and the compact will not render the positioning more difficult. The finished member is positioned on the shaft by means of the shaft-receiving opening of the bushing, which in most cases will consist of steel and because its material has been made by fusion metallurgy can accurately be machined at relatively low cost, contrary to a sintered compact. Besides, the bushing can be joined to the shaft by established technologies, inclusive of welding, and if the bushing and the shaft are made of the same material both parts will have the same coefficient of expansion, which is a further advantage. Finally, it is significant that during the sintering of the compact which contains the bushing made of a material formed by fusion metallurgy, the bushing will not take up liquid-phase material from the compact so that the sintered compact will not have a higher porosity adjacent to the bushing.

When a compact to be mounted onto a shaft is sintered when it is separate from the shaft, a radial deformation of the compact during its sintering can be prevented only if the compact lies on one of its end faces during the sintering process although this will result in disadvantages regarding a uniform supply and dissipation of heat and regarding dimensional stability because, e.g., cylindrical compacts will tend to assume a conical shape during the sintering process. These disadvantages can be avoided in a simple manner in the manufacturing process in accordance with the invention because the compact which contains the bushing can be sintered while it is suspended on a horizontal ceramic carrier. Owing to the play between the bushing and the compact the letter will rest only loosely on the bushing, which is supported by the ceramic carrier, so that symmetrical conditions will result from gravitation and will oppose in symmetrically shaped compacts a non-uniform deformation which might be caused by a non-uniform distribution of weight.

Owing to the play between the compact and the bushing contained therein, the compact need not have a particularly high strength, provided that it is so strong that it can be handled. In special cases, in which compacts having a higher strength are required, the compacts may be presintered, provided that care is taken that sufficient material for forming a liquid phase will be available for the sintering of the compact when it contains the bushing.

The bushing does not shrink during the sintering of the compact. To allow for the axial shrinkage of the compact, the bushing may be shorter than the compact to an extent which is at least as large as the axial shrinkage of the compact as it is sintered.

The play between the compact and the bushing should be sufficiently large so that the compact will not be subjected to an irregular deformation in spite of the restraint of its shrinkage by the bushing. On the other hand, the play should be so small that a strong metallurgical joint will be formed between the compact and the bushing. In most cases said requirements will be met in practice if the play between the compact and the bushing is between 60 and 80% of the extent of the unrestrained radial shrinkage of the compact at its through opening under the sintering conditions.

To ensure that the play between the compact and the bushing will be within a range in which the requirements for the manufacturing process will be met, the unrestrained radial shrinkage of the compact under the sintering conditions must not be to small, also in view of an economically satisfactory density of the compact. In experiments it has been found that for these reasons the extent of the unrestrained radial shrinkage under the sintering conditions should exceed 4% and should preferably lie between 6 and 8%.

DETAILED DESCRIPTION OF THE PREFERRED EMBODIMENT

Figure 1:
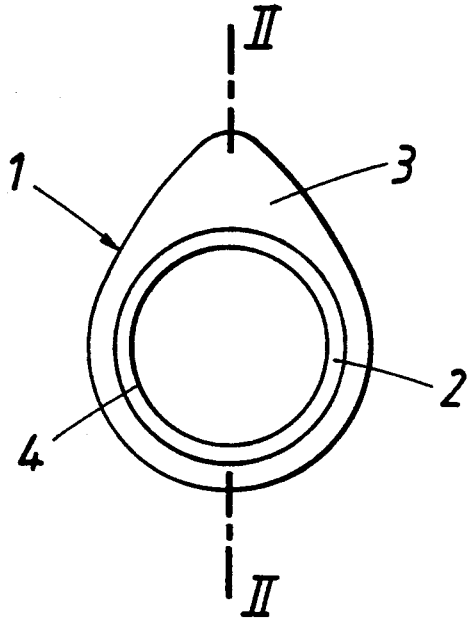
FIG. 1 is an end view showing a cam made in accordance with the invention.

The process in accordance with the invention will now be described in more detail with reference to the drawing.

Figure 2:
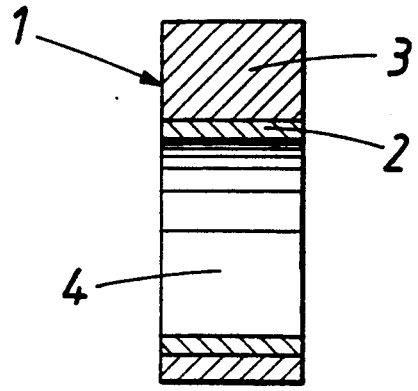
FIG. 2 is a sectional view taken on line II—II in FIG. 1.

The member 1 which has been manufactured by the process in accordance with the invention constitutes a cam for a camshaft of an internal combustion engine and in accordance with FIGS. 1 and 2 is composed of two parts, which consist of a bushing 2 made of a material which has been produced by fusion metallurgy, preferably of steel, and a sintered compact 3, which has been subjected to liquid-phase sintering to form a strong metallurgical joint between the sintered compact 3 and the bushing 2. The bushing 2 has a wall thickness which is sufficient to ensure the dimensional stability of the bushing under the sintering conditions so that the bushing 2 may be formed with a shaft-receiving opening 4 having the required dimensions or the bushing 2 may be finish-machined on its surface defining the opening 4 after the sintering process. Alteratively the bushing might entirely be removed by a boring operation after the sintering process.

To manufacture such a cam, a suitable sinterable powder is compacted to form a compact 5, which has a through opening 6 for receiving the bushing 2. The diameter of that through opening 6 exceeds the outside diameter of the bushing 2 to an extent which exceeds the extent of the unrestrained radial shrinkage of the compact 5 at the opening 6 under the sintering conditions. As a result, it is ensured that the bushing will restrain the radial shrinkage of the compact 5 at least during the final phase of the sintering process after the play 7 between the compact 5 and the bushing 2 has been eliminated. That restraint will ensure that the sintered compact 3 will exactly have the specified dimensions.

Figure 3:
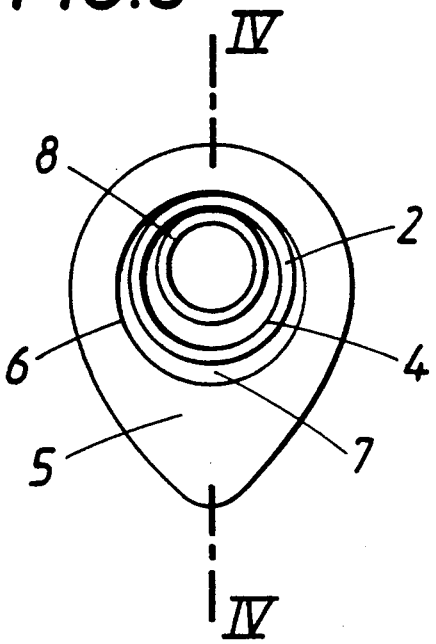
FIG. 3 is an end view showing the compact which contains the bushing and is suspended on a carrier for the sintering process.
Figure 4:
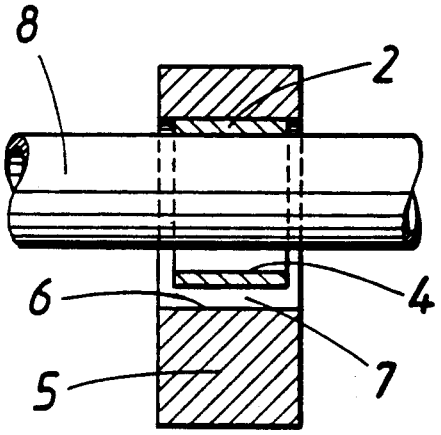
FIG. 4 is a sectional view taken on line IV—IV in FIG. 3.

As is apparent from FIGS. 3 and 4, and the bushing 2 is positioned within the compact 5 before the sintering process on a ceramic carrier 8, such as a tube, and the compact is sintered while suspended on said carrier. The sintering in that position permits a plurality of closely spaced compact to be sintered at the same time with a satisfactory supply and dissipation of heat and also permits a manufacture of members having exactly the specified dimensions because the uniform shrinking of the compact 5 during the sintering process will not adversely be affected if the play 7 between the compact 5 and the bushing 2 is between 60 and 80% of the extent of the unrestrained radial shrinkage o the compact 5 at the opening 6 under the sintering conditions. Said unrestrained radial shrinkage of the compact 5 should be between 6 and 8%.

To ensure that the bushing 2 will be flush with the sintered compact 3 or will be recessed from the ends of the sintered compact 3, the axial length of the bushing 2 must be smaller than the axial length of the compact 5 at least by the extent of the axial shrinkage of said compact during the sintering process, as is indicated in FIGS. 3, 4.

To make a cam 1 by the process described hereinbefore, a sinterable powder was compacted under a pressure of 8000 kg/cm$^2$ to form a compact 5 having a density of 6.6 g/cm$^3$ and an unrestrained radial shrinkage of about 7% under the sintering conditions at the opening 6. The bushing 2 was made from free-machining steel to have a wall thickness of 1.35. Suitable sinterable powders have been disclosed in my commonly assigned U.S. Pat. No. 5,069,867 whose disclosure is incorporated herein by reference. The play between the compact 5 and the bushing 2 amounted to 70% of the extent of the unrestrained radial shrinkage of the compact at the opening 6 under the sintering conditions. The sintering process was carried out at a sintering temperature of 1080° C. for a sintering time of 2 hours while the bushing 2 and the compact 5 thereon were suspended as shown in FIGS. 3 and 4. The sintered compact 3 had a density of 7.65 g/cm$^3$. The deviations of the outside peripheral surface of the sintered compact 3 from the specified shape were less than 0.05 mm. The material which had been selected for the bushing 2 readily permitted a boring of the bushing.

In the manufacture of a different member the bushing 2 was made of St 35 Steel whereas the other conditions were the same as those described hereinbefore. The bushing made of St 35 steel had substantially the same coefficient of expansion as the shaft.

I claim:

1. In a process of manufacturing a member having a shaft-receiving opening, in which a sinterable compact formed with a through opening and comprising a sinterable powder is subjected to liquid-phase sintering under predetermined sintering conditions, under which said compact has a predetermined radial shrinkage at said through opening, the improvement comprising the steps of inserting into said through opening a bushing which is dimensionally stable under said sintering conditions and consists of a material produced by fusion metallurgy, the bushing being so dimensioned that the play between said bushing and said compact is smaller than the extent of said unrestrained radial shrinkage, and then subjecting said compact to said liquid-phase sintering while said bushing is inserted in said compact.

2. The improvement set forth in claim 1, wherein said compact having said bushing inserted therein is subjected to said liquid-phase sintering while said compact and said bushing are suspended on a horizontal ceramic carrier.

3. The improvement set forth in claim 1, wherein said compact is presintered before said bushing is inserted into said compact.

4. The improvement set forth in claim 1, wherein said compact is subjected to said liquid-phase sintering under sintering conditions under which said compact has a predetermined axial shrinkage and said bushing has a length which is shorter than said compact at least to the extent of said axial shrinkage.

5. The improvement set forth in claim 1, wherein said play between said compact and said bushing is 60 to 80% of the extent of said unrestrained radial shrinkage of said compact at said through opening under said sintering conditions.

6. The improvement set forth in claim 1, wherein said compact is made to have under said sintering conditions an unrestrained radial shrinkage in excess of 4% at said through opening.

7. The improvement set forth in claim 6, wherein said compact is made to have under said sintering conditions an unrestrained radial shrinkage in excess of 6 to 8% at said through opening.

8. In a member having a shaft-receiving opening, comprising a sintered compact made by liquid-phase sintering and formed with a through opening, the improvement comprising a bushing defining said shaft-receiving opening, the bushing extending in said through opening and consisting of a material produced by fusion metallurgy and being fusion-bonded to said sintered compact at said through opening.

9. The improvement set forth in claim 8 as and the member to be mounted on a shaft which has a predetermined coefficient of expansion, wherein said bushing is made of a material having substantially the same coefficient of expansion as said shaft.

* * * * *